United States Patent [19]

Takenoya

[11] 4,368,683

[45] Jan. 18, 1983

[54] SEWING MACHINE WITH FEED DOG DROPPING SYSTEM

[75] Inventor: Hideaki Takenoya, Hachioji, Japan

[73] Assignee: Janome Sewing Machine Co. Ltd., Tokyo, Japan

[21] Appl. No.: 201,317

[22] Filed: Oct. 27, 1980

[30] Foreign Application Priority Data

Jul. 11, 1979 [JP] Japan ..... 54-153622[U]

[51] Int. Cl.[3] ..... D05B 27/00

[52] U.S. Cl. ..... 112/314

[58] Field of Search ..... 112/314, 315, 317, 319

[56] References Cited

U.S. PATENT DOCUMENTS

| | | | |
|---|---|---|---|
| 2,496,817 | 2/1950 | Schulthess | 112/314 |
| 2,681,628 | 6/1954 | Hoffmoister | 112/314 |
| 2,682,243 | 6/1954 | Matuzas | 112/314 |
| 4,159,004 | 6/1979 | Ross | 112/314 |
| 4,236,469 | 12/1980 | Takenoya et al. | 112/314 X |

*Primary Examiner*—H. Hampton Hunter

*Attorney, Agent, or Firm*—Michael J. Striker

[57] ABSTRACT

A sewing machine with a feed dog vertically displaceable between an upper operative position and a lower inoperative position has a control element connected with a control shaft of a control motor and turnable by the latter within a predetermined range in two opposite directions, a cam element displaceable from an inoperative position to an operative position by the control element during turning of the latter in one of the directions, a cam follower normally engaging the cam element and displaceable from an inoperative position to a set position by the cam element during displacement of the latter from its inoperative position to its operative position and being further displaceable to an operative position by the control element during turning of the latter in the other of the directions, and a transmitting element operatively connected with the cam follower and the feed dog and operated by the cam follower during displacement of the latter from its set position to its operative position so as to displace the feed dog from its upper operative position to its lower operative position.

6 Claims, 5 Drawing Figures

SEWING MACHINE WITH FEED DOG DROPPING SYSTEM

BACKGROUND OF THE INVENTION

The invention relates to a sewing machine, and more particularly relates to a feed dog dropping system of the sewing machine which is operated to displace the feed dog from an upper operative position to a lower inoperative position and vice versa in dependence upon a selected stitch pattern. The same applicant's copending U.S. patent application Ser. No. 6,685, now U.S. Pat. No. 4,236,469, dated Dec. 2, 1980 discloses a similar system including an electromagnetic device such as a solenoid which is energized to connect a feed control pulse motor to a transmission linkage operatively connected to a plunger device which is operated to displace the feed dog from the upper operative position to the lower inoperative position.

Such a prior art requires a considerably large sized solenoid for a limited space of the machine housing and makes the structure considerably complex, and moreover such a system is costly.

SUMMARY OF THE INVENTION

The invention has been provided to eliminate such defects and disadvantages of the prior art. For attaining this object, the present invention provides a control member secured to the control shaft of a control motor such as a pulse motor, which is turned in a predetermined range to control the horizontal feeding movement of the feed dog. The control member is turned in one direction beyond the predetermined range to operate a feed dog switching mechanism into a set condition, and is turned in the opposite direction within a predetermined range to operate the feed dog switching mechanism into an operative condition, thereby to displace the feed dog from the upper operative position to the lower inoperative position. The control member is turned again in said one direction to release the feed dog switching mechanism allowing the same to return to the initial condition for displacing the feed dog from the lower inoperative position to the upper operative position. Then the control member is turned again in the opposite direction within the predetermined range for controlling the horizontal feeding movement of the feed dog.

It is a primary object of the invention to provide a feed dog dropping system of simple structure as well as of a smooth and positive operation.

It is another object of the invention to reduce the production cost of such a system.

The other features and advantages of the invention will be apparent from the following description of a preferred embodiment in reference to the attached drawings.

DETAILED DESCRIPTION OF THE INVENTION

Figure 1:
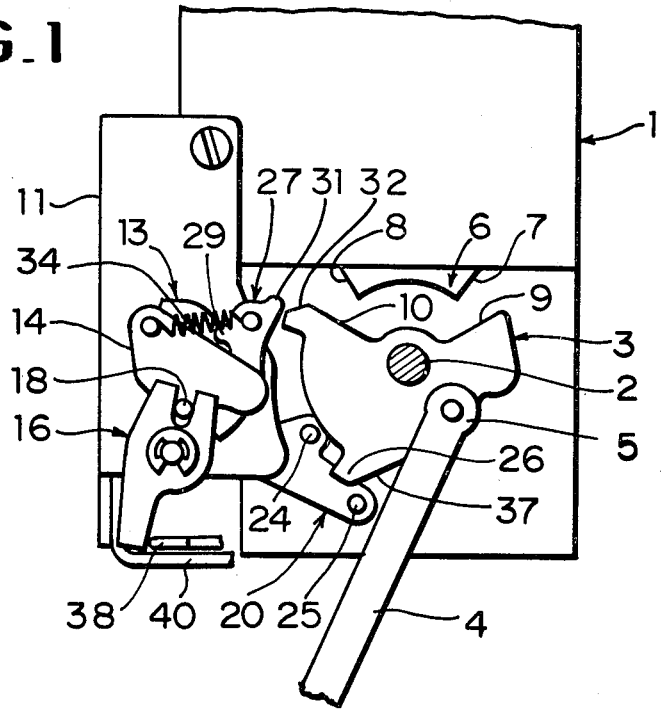
FIG. 1 is a front elevational view of the invention.

In reference to FIG. 1, the numeral 1 is a mount secured to a suitable part within the machine housing (not shown). A control motor such as a pulse motor is secured to the rear side of the mount 1 for controlling the horizontal movement of the feed dog of the sewing machine. The numeral 2 is a rotatable control shaft of the pulse motor extended through the mount 1 to the front side thereof. A horizontal feed control member 3 is a secured to the end of the motor shaft 2 and is connected to one end 5 of the transmission link 4, the other end of which being connected to an adjustable feed regulator (not shown) for regulating the horizontal movement of the feed dog. The mount 1 is formed with a stopper 6 having opposite abutments 7 and 8 to be engaged by the abutments 9 and 10 of the feed control member 3 respectively to forcibly stop the rotation of the pulse motor for the sake of safety. Actually the pulse motor is to be stopped just before the feed control member 3 engages the stopper 6. The maximum counterclockwise position of the pulse motor at which it stops corresponds to a position of the feed regulator adjusted to the resultant feeding amount 4 mm of the feed dog in the forward direction. On the other hand, the maximum clockwise position of the pulse motor at which it stops corresponds to the feeding amount 4 mm of the feed dog in the rearward direction. However, in this respect, the actual feeding amount is 2.5 mm to the maximum and the spare rotational movement of the pulse motor is utilized to switch the function of the feed dog as will be mentioned herein later. FIG. 1 shows the relative positions of constituent parts to hold the feed dog in the operative position for the standard horizontal feeding in the forward direction.

Figure 2:
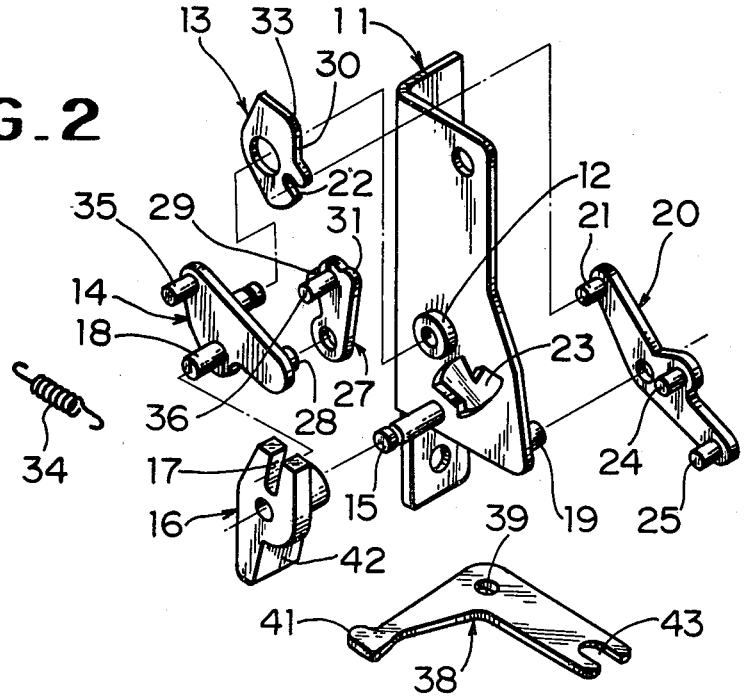
FIG. 2 is an exploded view of the invention.

In reference to FIGS. 1 and 2, the numeral 11 is a bracket secured to the mount 1. As shown, the bracket 11 is formed with a collar 12 on which a cam element 13 and an arm 14 are turnably mounted. The bracket 11 is provided with a transverse pin 15 on which a lever 16 is turnably mounted. The lever 16 is forked at the upper part 17 thereof for receiving therein the transverse pin 18 of the arm 14. The bracket 11 is provided with another transverse pin 19 on which an operating lever 20 is turnably mounted. The transverse pin 21 of the operating lever 20 engages the cutout 22 of the cam element 13 through an opening 23 of the bracket 11. The operating lever 20 is provided with other two transverse pins 24 and 25 which are spaced from each other. In the condition of FIG. 1 showing the standard forward feed control of the sewing machine, the operating lever 20 is turned in the clockwise direction to the maximum and the pin 25 is locked out of the travelling path of the pawl 26 of the feed control member 3 allowing the maximum counterclockwise turning movement of the feed control member 3. On the other hand, the pin 24 of the operating lever 20 is locked in the travelling path of the pawl 26 to engage the pawl 26, thereby to block the clockwise rotation of the feed control member 3 at the angular position thereof for providing the feeding amount 2.5 mm in the rearward direction.

A cam follower 27, which is formed with a follower portion 29 and a pawl 31, is turnably mounted on the pin 28 of the arm 14. The follower 27 is, at the follower portion 29 thereof, normally pressed against the cam face 30 or 33 of the cam element 13 by a tension spring 34 which is at one end connected to the pin 35 of the arm 14 and is at the other end connected to the pin 36 of the cam follower 27. When the follower 27 engages the lower cam face 30 of the cam element 13, the pawl 31 of the follower 27 is in a position spaced from the pawl 32 of the feed control member 3 as shown in FIG. 1. If the feed control member 3 is turned in the clockwise direction, the pawl 26 of the feed member 3 engages the pin 24 of the operation lever 20. As the feed control member 3 is further turned, the operation lever 20 is turned in the counterclockwise direction, and then the cam element 13 is turned in the clockwise direction. As a result, the follower portion 29 of the follower 27 engages the higher cam face 33 of the cam element 13, and the follower 27 is turned in the clockwise direction and the pawl 31 of the follower 27 is displaced to a position between the pawls 26 and 32 of the feed control member 3, so that the pawl 31 may be engaged by the pawl 32 when the feed control member 3 is turned in the counterclockwise direction. In this condition, if the feed control member 3 is turned in the counterclockwise direction, the part 37 of the feed control member 3 engages the pin 25 of the operating lever 20 to turn the lever 20 in the clockwise direction, thereby to turn the cam element 13 in the counterclockwise direction. Thus, the follower 27 is returned to the initial position as shown in FIG. 1 where the follower portion 29 of the follower 27 engages the lower cam face 30 of the cam element 13.

An L-shaped lever 38 is turnably mounted on a plate 40 secured to the mount 11 and is normally biased in the clockwise direction by a spring (not shown) in FIGS. 1 and 2. The L-shaped lever has one end 41 which is normally in engagement with the lower transmission part 42 of the lever 16, and has the other forked end 43 which is operatively connected to the device for changing the vertical position of the feed dog (not shown). As aforementioned, FIG. 1 shows the condition of parts for holding the feed dog in an operative position for producing the standard feeding amount. If the lever 16 is turned in the counterclockwise direction, the feed dog is displaced down to the inoperative position.

With the foregoing structure of the invention, the operation thereof is as follows:

The horizontal feed control motor such as a pulse motor having the rotatable control shaft 2 is driven and stopped by an electric control device which is selectively operated from a pattern selecting device usually arranged on the front face of the sewing machine, though these devices are not shown. Further this invention includes a micro-computer memorizing various program control signals, stitch control signals, etc. If the pattern selecting device is selectively operated, the micro-computer is operated to discriminate if the selected pattern requires the fabric feeding function of the feeding dog. If the feeding function is required, the micro-computer sets the feeding device at a predetermined feeding amount per stitch of the selected pattern.

Figure 3A:
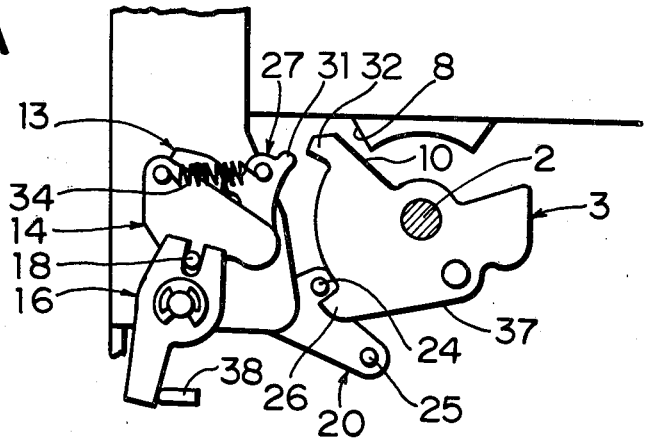
FIGS. 3-A, 3-B and 3-C are explanatory operational views of the invention.
Figure 3B:
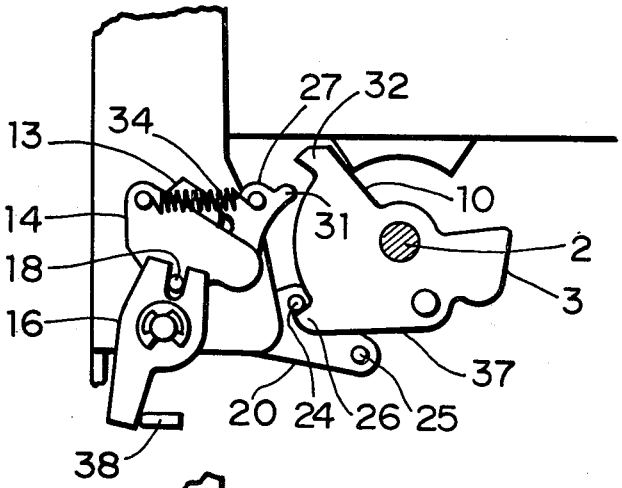
Figure 3C:
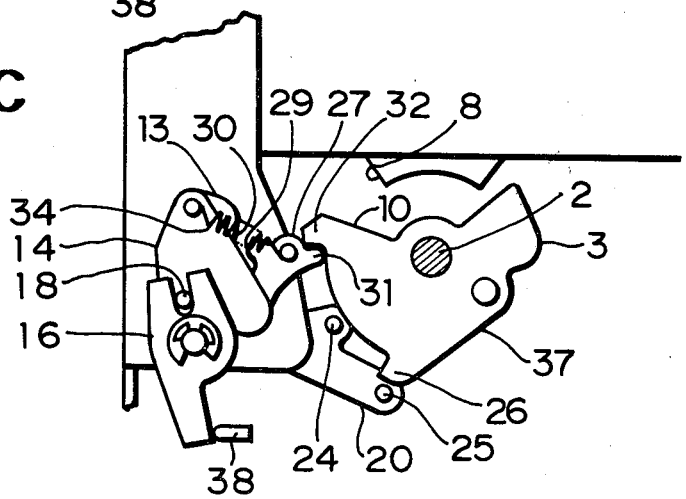

As mentioned hereinbefore, FIG. 1 shows the condition of parts making the feeding device operative in accordance with a selected pattern. If the machine operator selects a stitch pattern such as the basting stitch requiring no feeding function, the pulse motor shaft 2 and accordingly the horizontal feed control member 3 is turned in the clockwise direction, and the pawl 26 of the feed control member 3 comes to engage the pin 24 of the operating lever 20 as shown in FIG. 3-A. As the feed control member 3 is further turned, the feed control member 3 turns the operating lever 20 in the counterclockwise direction. Then, the cam element 13 is turned in the clockwise direction as shown in FIG. 3-B. The follower portion 29 of the follower 27, therefore, engages the higher cam face 33 from the lower cam face 30 of the cam element 13. The follower 27 is turned in the clockwise direction and the pawl 31 of the follower 27 is displaced into the travelling path of the pawl 32 of the feed control member 3. Then the motor shaft 2 turns the feed control member in the counterclockwise direction. Therefore, the pawl 32 of the feed control member engages the pawl 31 of the follower 27 and turns the follower 27 in the clockwise direction as shown in FIG. 3-C, and therefore, the arm 14 is turned together in the same direction. As a result, the transmission lever 16 is turned in the counterclockwise direction, and therefore the L-shaped lever 38 is turned in the counterclockwise direction in FIG. 2. Thus, the L-shaped lever 38 displaces the feed dog down into the inoperative position, and then the pulse motor is stopped to hold the feed dog in the inoperative position until the pattern selecting device is newly operated to select a different pattern requiring the fabric feeding function of the feed dog.

During the counterclockwise rotation of the feed control member 3 from the condition in FIG. 3-A to the condition in FIG. 3-C, the release part 37 of the feed control member 3 engages the pin 25 of the operating lever 20 to turn the same in the clockwise direction. The cam element 13 is, therefore, turned in the counterclockwise direction and is returned to the position as shown in FIG. 3-A where the lower cam face 30 is opposite to the follower portion 29 of the follower 27 while the follower 27 remains in engagement with the feed control member 3 as shown in FIG. 3-C where the follower 27 is spaced from the cam element 13.

In the condition of FIG. 3-C, if the machine operator selects a different pattern requiring the feeding function of the feed dog, the motor shaft 2 turns the feed control member 3 in the clockwise direction. When the feed control member 3 is turned to a position as shown in FIG. 3-A, where the follower 27 is released from the feed control member 3 and returned, by the tension spring 34, to the initial position where the follower portion 29 of the follower 27 engages the lower cam face 30 of the cam element 13. Then the transmission lever 16 is turned in the clockwise direction by a spring (not shown) normally biasing the L-shaped lever 38 in the clockwise direction. Thus, the L-shaped lever 38 returns the feed dog up to the operative position.

It will be understood that each of the elements described above, or two or more together, may also find a useful application in other types of constructions, differing from the types described above.

While the invention has been illustrated and described as embodied in a sewing machine with feed dog dropping system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sewing machine, comprising a feed dog vertically displaceable between an upper operative position and a lower inoperative position and horizontally movable for feeding; a fabric feed regulator adjustably operative to control the horizontal feeding movement of said feed dog; a control motor having a control shaft operatively connected with said fabric regulator to adjustably set the latter in accordance with a selected stitch pattern; control means connected with said control shaft and turnable by the latter within a predetermined range in two opposite directions; a cam element displaceable from an inoperative position to an operative position by said control means during turning of the latter in one of said directions; a cam follower normally engaging said cam element and displaceable from an inoperative position to a set position by said cam element during displacement of said cam element from its inoperative position to its operative position, said cam follower in said set position being further displaceable to an operative position by said control means during turning of the latter in the other of said directions; and transmitting means operatively connected with said cam follower and said feed dog and operated by said cam follower during displacement of said cam follower from its set position to its operative position to displace said feed dog from its upper operative position to its lower inoperative position.

2. A sewing machine as defined in claim 1; and further comprising a device for changing the vertical position of said feed dog so that the latter assumes its upper operative position and its lower inoperative position, said transmitting means having one part operatively connected with said cam follower and another part operatively connected with said device so as to change the vertical position of said feed dog.

3. A sewing machine as defined in claim 1, wherein said control means is arranged to return said cam element to its initial inoperative position during the turning of said control means in said other direction.

4. A sewing machine as defined in claim 3, wherein said control means is provided with a cam element releasing portion operatively connected with said cam element during the turning of said control means in said other direction so as to return said cam element to its initial inoperative position.

5. A sewing machine as defined in claim 1, wherein said transmitting means is normally biased in a direction for displacing said feed dog from its lower inoperative position to its upper operative position, said control means being turnable again in said one direction to release said cam follower and thereby to allow said transmitting means to displace said feed dog from its lower inoperative position to its upper operative position.

6. A sewing machine as defined in claim 5; and further comprising spring means arranged to bias said transmitting means in said direction for displacing said feed dog from its lower inoperative position to its upper operative position.

* * * * *